US007418895B2

(12) United States Patent
Donovan et al.

(10) Patent No.: US 7,418,895 B2
(45) Date of Patent: Sep. 2, 2008

(54) PURGING AN AIRLOCK OF AN EXPLOSION CONTAINMENT CHAMBER

(75) Inventors: John L. Donovan, Danvers, IL (US); Jay M. Quimby, Parsippany, NJ (US); McRea B. Willmert, Wilsonville, OR (US)

(73) Assignee: DeMil International, Inc., Englewood, CO (US)

( * ) Notice: Subject to any disclaimer, the term of this patent is extended or adjusted under 35 U.S.C. 154(b) by 270 days.

(21) Appl. No.: 10/744,703

(22) Filed: Dec. 23, 2003

(65) Prior Publication Data

US 2005/0022656 A1 Feb. 3, 2005

Related U.S. Application Data

(63) Continuation-in-part of application No. 09/683,495, filed on Jan. 8, 2002, now Pat. No. 6,705,242.

(60) Provisional application No. 60/468,437, filed on May 6, 2003.

(51) Int. Cl.
*F42B 33/00* (2006.01)

(52) U.S. Cl. ..... 86/50; 588/403; 588/900

(58) Field of Classification Search ..... 86/50; 588/403, 261, 900; 264/84, 101; 29/421.2; 425/1; 72/56
See application file for complete search history.

(56) References Cited

U.S. PATENT DOCUMENTS 2,807,056 A 9/1957 Vogt
2,977,106 A 3/1961 Duff
3,032,835 A 5/1962 Saar et al.
3,150,618 A 9/1964 Rosenfeld
3,678,624 A 7/1972 Bicicchi
3,711,993 A 1/1973 Liesch et al.
3,766,844 A 10/1973 Donnelly et al.
4,111,753 A 9/1978 Folsom et al.
5,233,932 A 8/1993 Robertson
5,263,425 A 11/1993 Koenig
5,331,106 A 7/1994 Spas
5,419,862 A 5/1995 Hampel et al.
5,607,353 A 3/1997 Hutchings et al.
5,711,706 A 1/1998 Griffin et al.
5,884,569 A 3/1999 Donovan
RE36,912 E 10/2000 Donovan
6,173,662 B1 1/2001 Donovan
6,245,958 B1 6/2001 Morse et al.
6,603,050 B2 8/2003 Heaton

*Primary Examiner*—James S Bergin
(74) *Attorney, Agent, or Firm*—Perkins Coie LLP

(57) ABSTRACT

Apparatus and methods are provided for purging an airlock cavity created between the airlock access door and the primary explosion chamber opening sealing mechanism. According to one embodiment of the present invention, an airlock device is used to ensure that, in the event toxins are released from the primary explosion chamber opening sealing means, the toxins are properly handled and are not inadvertently released into the atmosphere. In one embodiment, negative pressure is used to vacuum the entrained air within the airlock cavity subsequent to an explosion. To facilitate the sweeping and exhausting of the cavity, an orifice in the access door may be operable to allow the flow of ambient air through the airlock access door.

16 Claims, 2 Drawing Sheets

PURGING AN AIRLOCK OF AN EXPLOSION CONTAINMENT CHAMBER

This is a continuation-in-part of application Ser. No. 09/683,495 filed Jan. 8, 2002, now U.S. Pat. No. 6,705,242 and which is hereby incorporated by reference in its entirety. This application also claims the benefit of priority of U.S. Provisional Application No. 60/468,437, filed May 6, 2003, which is hereby incorporated by reference in its entirety.

COPYRIGHT NOTICE

Contained herein is material that is subject to copyright protection. The copyright owner has no objection to the facsimile reproduction of the patent disclosure by any person as it appears in the Patent and Trademark Office patent files or records, but otherwise reserves all rights to the copyright whatsoever.

BACKGROUND

1. Field

Embodiments of the present invention relate generally to methods and apparatus for containing, controlling and suppressing the detonation and destruction of explosives and resultant toxic materials released, specifically biological and chemical weapons. More particularly, embodiments of the present invention relate to purging an airlock cavity of an explosion suppression and containment chamber to minimize the risk of environmental contamination as a result of leaks from the main method of sealing the openings of the explosion suppression and containment chamber.

2. Description of the Related Art

Currently, explosion containment and suppression chambers are utilized for many purposes, ranging from hardening of steel and metals to the destruction of weaponry or other explosive devices. Some common types of weaponry and other explosive devices which are intended to be destroyed within such an explosion chamber include, but are not limited to, munitions, mortars, pipe bombs, fireworks, biological, chemical and other toxin-releasing agents.

These types of weaponry and explosive devices are generally destroyed by detonating the weapon with a predetermined amount of explosive material. For example, to destroy a chemical agent weapon, the weapon is generally encased with an explosive material, placed inside of the explosion suppression and containment chamber, wherein the explosive material is detonated and the weapon is essentially vaporized. Due to the extreme and instantaneous temperature and pressure increase, substantially all of the toxic material contained within the weapon is vaporized and subsequently consumed in a fireball.

The main purpose of an explosion suppression and containment chamber is to contain and ultimately suppress the explosive forces inherent with the destruction of such weaponry and explosive devices. Furthermore, the explosion chamber is intended to provide an airtight explosion atmosphere. Whatever toxic materials remain after weapons destruction these materials remain contained in an enclosed environment where they can be properly handled and disposed of. U.S. Pat. Nos. 6,354,181; 6,173,662; 5,884,569; and Re. 36,912, each of which are hereby incorporated by reference in their entirety, disclose a system which has exhaust orifices located along the perimeter of the explosion chamber to collect contained toxic gases and contaminants. These exhaust orifices are subsequently connected to manifolds, which run along the length of the explosion chamber. The manifolds are then connected to an air handling and cleaning device, such as an air scrubber. As such, once an explosion within the chamber commences, there is an exhaust fan which pulls the toxic laden air that escaped destruction in the fireball, due to the vaporization of the weapon and any contained chemical or biological agents, through the exhaust orifices, into the manifolds system and finally to the air handling and cleaning device. Once the air has been properly cleaned and stripped of toxic materials, it can then be released into the atmosphere.

As can be expected, there are many dangerous and toxic materials that can be destroyed within the explosion containment and suppression chamber. It is thus imperative that these dangerous toxins are properly contained and not allowed to enter the atmosphere as toxin release can be extremely deadly to the human population. As stated previously, the initial destruction of the weapon by explosion vaporizes substantially all of the toxic material which is then destroyed in a fireball. However, there are inevitably some traces of toxins in the air within the explosion suppression and containment chamber.

As disclosed in U.S. Pat. Nos. 6,354,181; 6,173,662; 5,884,569; and Re. 36,912, an airtight explosion chamber is utilized to destroy such weapons. To enhance the chamber's airtight design, disclosed therein is the utilization of an access door which opens inwardly into the explosion chamber. Thus, when the explosion occurs, the explosion itself has the effect of providing a tighter seal around the periphery of the door due to the explosion's outward forces, subsequently sealing the door even further. However, a limitation of such a design is that this type of interior access, although extremely reliable and effective, is the only method utilized to prevent inadvertent release of toxic gases and materials from the explosion chamber.

SUMMARY

Apparatus and methods are described for purging contaminants from an airlock cavity created between the airlock access door and the primary explosion chamber opening sealing mechanism. According to one embodiment of the present invention, an airlock device is used to minimize the risk that, in the event toxins are released from the primary explosion chamber opening sealing means, the toxins are not inadvertently released into the atmosphere. In one embodiment, negative pressure is used to vacuum the entrained air within the airlock cavity subsequent to an explosion. To facilitate the sweeping and exhausting of the cavity, an orifice in the access door may be operable to allow the flow of ambient air through the airlock access door.

BRIEF DESCRIPTION OF THE SEVERAL VIEWS OF THE DRAWINGS

Embodiments of the present invention are illustrated by way of example, and not by way of limitation, in the figures of the accompanying drawings and in which like reference numerals refer to similar elements and in which.

DETAILED DESCRIPTION

Figure 1:
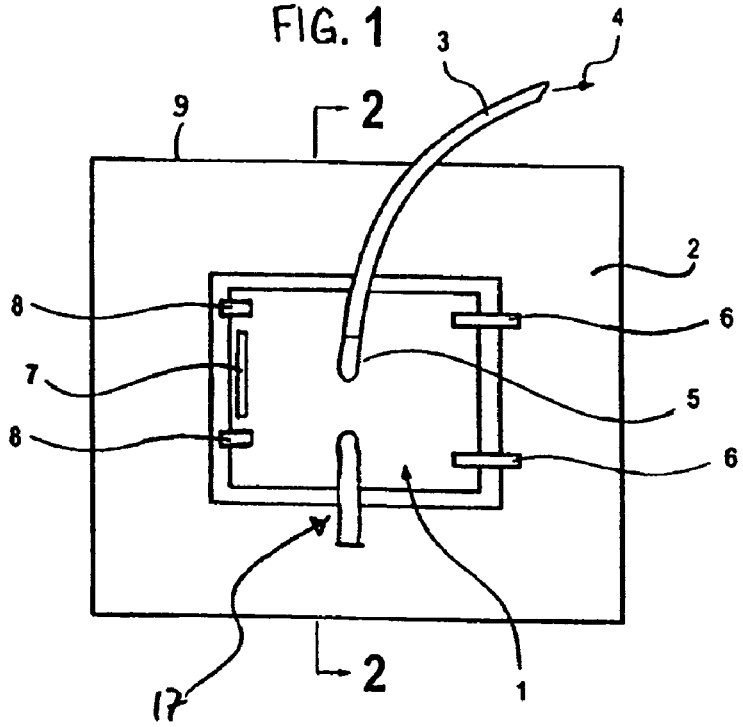
FIG. 1 is an elevation view of the outside plane of an airlock access door in a closed state according to one embodiment of the present invention.

Apparatus and methods are described for providing an airlock assembly which acts as a backup mechanism to minimize the risk of toxic leaks from an explosion suppression chamber in the event that toxins are released from a primary explosion suppression chamber opening sealing mechanism. Embodiments of the present invention overcome the above-noted limitations by, for example, providing a self-contained cavity between the primary door of an explosion suppression chamber and the environment. Advantageously, in this manner, a mechanism is provided to minimize the risk of toxins being released into the environment.

Embodiments of the present invention may utilize a conventional self-sealing door which may include a resilient sealing member around the periphery of the door surface to ensure an airtight intersection against the sealing seat of the explosion chamber. The self-sealing door may be hinged in an inwardly closing manner. When the door is closed, an airlock cavity is provided between the primary door of the explosion suppression chamber and the airlock assembly described herein.

According to one embodiment of the present invention, a mechanism is provided to continuously purge the airlock cavity created between the airlock access door and the primary explosion chamber opening sealing mechanism. The airlock access door and associated continuous purge mechanism may be utilized with the various explosion suppression chambers disclosed in U.S. Pat. Nos. 6,354,181; 6,173,662; 5,884,569; and Re. 36,912. However, it is contemplated that embodiments of the present invention will be equally applicable to various other configurations and useful in connection with different types and designs of explosion suppression chambers, or other devices which require such an airlock design.

Embodiments of the present invention may incorporate a plurality of penetrations/orifices through the outer door. One of the orifices in the outer door may be coupled to a vacuum tube through an exhaust valve connected to the explosion chamber's air handling device. Another orifice may be coupled to a purge valve that serves as an ambient air inlet into the airlock cavity to relieve the vacuum pressure within the airlock cavity. The proximate end of the vacuum tube is connected to one of the orifices located within the airlock door and is connected to the explosion chamber's air handling device at its distal end.

According to one embodiment, subsequent to detonating an explosion, the air-handling device may be started and the vacuum tube evacuates the air and air particles within the airlock, including any toxins that have moved from the chamber into the airlock through the primary door sealing means. According to one embodiment, the purge valve remains open during detonation of an explosion and provides a constant ambient air purging feature to sweep and exhaust the cavity between the doors. For example, the explosion suppression chamber's air treatment system may be started prior to detonation of an explosion and a manually operated ball valve representing the purge valve may be opened prior to detonation of the explosion. In this manner, the explosion suppression chamber's air treatment system effectively pulls ambient air through the purge valve into the airlock cavity chamber and evacuates toxic gases and contaminants, which may have been released from the chamber into the cavity via the primary door, through the exhaust valve.

According to one embodiment, the purge valve is a manually operated ball valve having a one inch diameter. However, in alternative embodiments, other manually or automatically controlled penetrations in the outer door may be employed and may be of different diameters depending upon the desired ventilation rate. In operation, when the inner door is closed, the outer door is closed and the purge valve is closed, a vacuum between the doors is created by the process fan. The vacuum can be released by opening the purge valve and thereby inducing ambient air to sweep and exhaust the cavity between the doors. In addition to inducing proper ventilation, this makes it easier to open the outer door. According to one embodiment, the ventilation rate between the doors is on the order of 10 to 40 cubic feet per minute. This airlock cavity ventilation mechanism is an improvement since it facilitates opening of the outer door and clears toxic gases that may otherwise have been trapped between the inner and outer doors. Such gases could otherwise mix with the surrounding environment, possibly exposing workers, when the outer door is opened.

Figure 2:
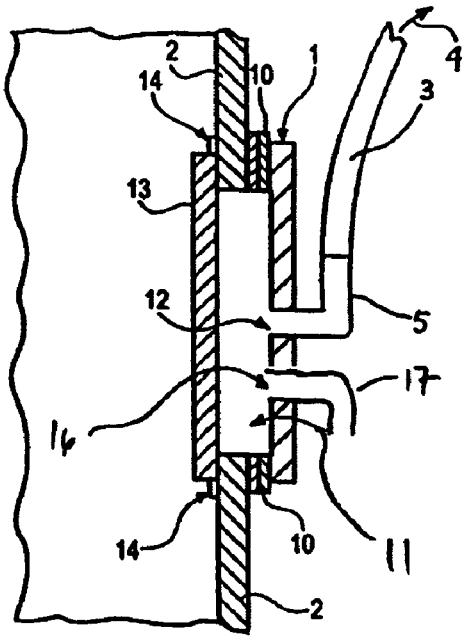
FIG. 2 is a detailed cross-sectional view taken along cut line A-A of FIG. 1.
Figure 3:
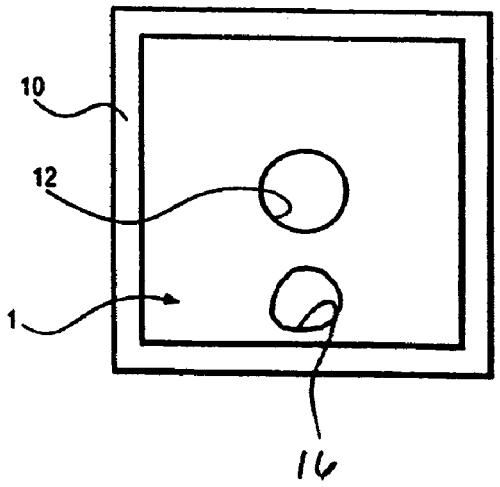
FIG. 3 is an elevation view of the inside plane of the airlock access door of FIG. 1.

Referring to FIGS. 1, 2 and 3, an airlock door 1 is preferably pivotally connected to the outside face of an explosion suppression chamber 2 with an attaching means 6. The attaching means 6 may be a pivotal mount, such as a hinge device, configured to close inwardly towards the explosion suppression chamber 2. Alternately, other types of attaching means 6 may be utilized, such as a threaded bolting means, attaching clasps, or the like. The airlock door 1 may be constructed of a non-corrosive material, such as hardened steel, fiberglass, plastics, composite resins or the like.

According to one embodiment of the present invention, the airlock door 1, when in a closed and sealed position, is seated into a door seal seat 9, which may be an integrated component of the explosion suppression chamber 2 outer wall. Alternately, the airlock door 1 may seat flush against the exterior surface of the explosion suppression chamber 2. In one embodiment, a sealing membrane 10 is placed along the intersection between the airlock door 1 and the door seal seat 9. The sealing membrane 10 may be attached to the interior periphery of the airlock door 1. Alternately, the sealing membrane 10 may be attached to the periphery of the explosion chamber access location. Still alternately, the sealing membrane 10 may be manually placed prior to closing the airlock door 1. The sealing membrane 10 may be constructed of a flexible, resilient material that is non-reactive to the toxins and chemicals typically found in military weaponry.

Furthermore, in one embodiment, the airlock door 1 may include at least one handle 7 to aid in opening the airlock door 1. Alternately, the airlock door 1 can be mechanically or hydraulically operated to facilitate opening and closing.

According to one embodiment, a locking means 8 may be employed to ensure that an airtight seal between the airlock door 1 and the door seal seat 9 is established and maintained once the airlock door 1 is in a closed position and is locked with the locking means 8. The locking means may be hand-tightened threaded bolts with a handle extension. As such, when the airlock door 1 is in a closed position, cavity 11 is created between the inner surface of the airlock door 1 and the outer surface of the primary door 13. The cavity 11 traps air and air contaiminants that might escape from the interior of the explosion suppression chamber 2 through the seal 14 of the primary door 13, thus reducing the risk of toxic leakage from the interior of the chamber into the environment.

According to one embodiment of the present invention, the airlock door 1 includes a plurality of penetrations/orifices 12 and 16. One of the orifices 12 may be coupled to an outlet hose 3, which may be a flexible hose, at the proximate end of the outlet hose 3 via a hose connecting means 5, such as an automatic or manually operable ball valve which serves as an exhaust valve for air exiting the cavity 11. While, in the example illustrated, the orifice 12 is located at the approximate center of the airlock door 1, in alternative embodiments, the orifice 12 that the outlet hose 3 is connected to can be located at other locations within the airlock door 1. The distal end of the outlet hose 3 may be connected to an air pressure adjusting apparatus, such as an exhaust fan, vacuum pump, or other similar device. As such, the air pressure adjusting apparatus provides vacuum force to provide negative, vacuum pressure, to evacuate potentially contaminated air contained within the cavity 11 through the cavity outlet orifice 12 when the air pressure adjusting apparatus is activated. In another embodiment, the distal end of the outlet hose 3 may be connected to an air treatment system, such as the system described in U.S. Provisional Application No. 60/468,437, filed May 6, 2003.

According to the embodiment depicted, a second orifice 16 is connected to a purge valve 17 that serves as an inlet for ambient air to be swept through (e.g., pushed or pulled) the cavity 11. According to one embodiment, the purge valve 17 is closed during detonation of an explosion and then is automatically or manually operable to relieve the vacuum pressure in the cavity 11 created by the air pressure adjusting apparatus after the detonation. Alternatively, during detonation of an explosion, the air pressure adjusting apparatus may be running and both the exhaust valve 5 and the purge valve 17 may remain open, thereby providing a constant ambient air purging feature which sweeps and exhausts the cavity 11 between the doors. In either case, the air-handling device evacuates the air within the cavity 11 through the outlet hose 3, including any inadvertently released toxins that have moved from the interior of the explosion suppression chamber 2 into the cavity 11 through the primary door's 13 sealing means.

Figure 4:
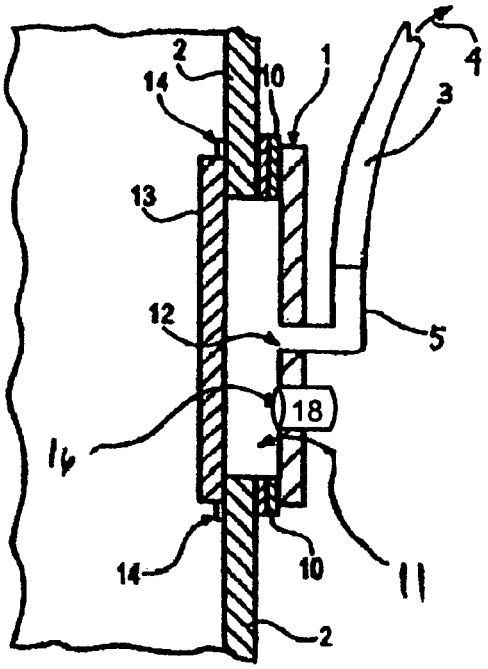
FIG. 4 is a detailed cross-sectional view of an airlock cavity according to an alternative embodiment of the present invention.
Figure 5:
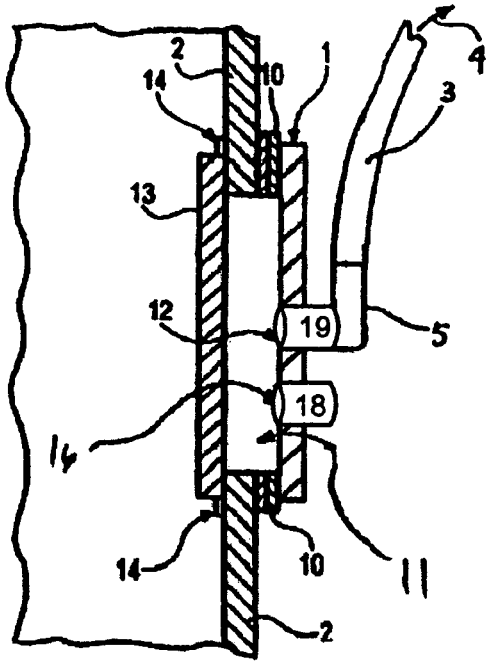
FIG. 5 is a detailed cross-sectional view of an airlock cavity according to another alternative embodiment of the present invention.

Alternative embodiments of the present invention which use at least one one-way filter membrane or a one-way check valve placed within the airlock door 1 are illustrated in FIGS. 4 and 5. In FIG. 4, the one-way filter membrane or check valve 18 can be configured in such a way as to allow air to flow into the cavity 11 while preventing air within the cavity 11 from exiting. As such, while applying negative, vacuum pressure to the cavity 11, the filter member or check valve allows a continuous flow of fresh air to enter the cavity 11, thus providing enhanced air flow and air replacement within the cavity 11.

According to yet another alternate embodiment of the present invention, depicted in FIG. 5, multiple filter membranes 18 and 19 may be utilized and the filter membrane trapping size utilized is based upon the type of expected toxins needing containment. For example, if a viral containing biological weapon is destroyed within the explosion suppression chamber 2, a filter membrane trapping size suitable to filter particulate up to 1 micron in size can be utilized. While in the embodiment depicted filter membrane 19 is shown as being located within orifice 12, in alternative embodiments, filter membrane 19 may be located within the hose connecting means 5, within the outlet hose 3, or at the distal end of the outlet hose 3.

Figure 6:
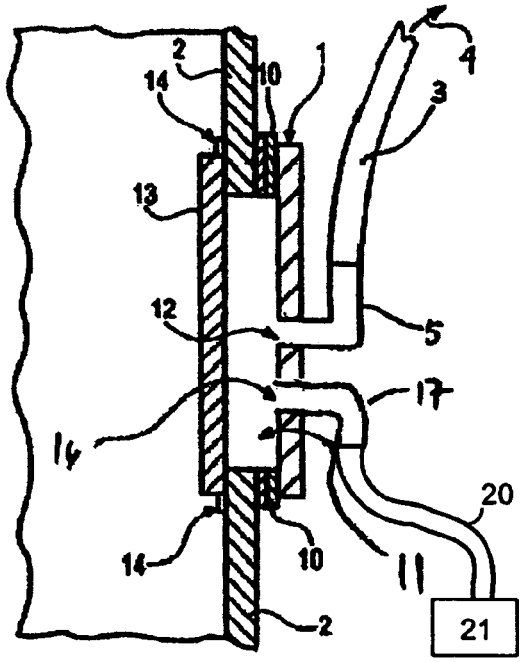
FIG. 6 is a detailed cross-sectional view of an airlock cavity according to yet another alternative embodiment of the present invention which includes an air compressor.

According to yet another alternative embodiment of the present invention, depicted in FIG. 6, to clean potentially toxic air within the cavity 11, the air pressure adjusting apparatus can be an air compressor device 21 thus delivering positive pressurization to cavity 11 via an inlet hose 20, which may be a flexible hose, connected to the hose connecting means 17. In embodiments including one or more filter membranes, the air compressor device 21 can be used to force the air within the cavity 11 through the one or more filter membranes. Still alternately, different air delivery hoses and means can be utilized apart from the hoses 3 and 20.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. An airlock apparatus to seal an opening of an explosion containment chamber that is susceptible to environmental leakage comprising:

a pair of doors including an inner door and an outer door attached to the explosion containment chamber proximate the opening, the pair of doors when in a closed position forming therebetween a cavity;

an exhaust path carrying potentially contaminated air out of the cavity, wherein the cavity is intermediate the exhaust path and the explosion containment chamber;

a purge path introducing ambient air into the cavity; and an air pressure adjustment device coupled to one of the exhaust path or the purge path to induce the flow of ambient air through the cavity.

2. The airlock apparatus of claim 1 further comprising an air treatment system operatively associated with the exhaust path.

3. The airlock apparatus of claim 1, wherein the air pressure device comprises an exhaust fan coupled to the exhaust path.

4. The airlock apparatus of claim 1, wherein the air pressure adjustment device comprises an air compressor coupled to the purge path.

5. The airlock apparatus of claim 1 wherein the purge path includes an inlet orifice through which ambient air is introduced into the cavity.

6. The airlock apparatus of claim 1, further comprising a purge valve associated with the purge path, wherein the purge valve releases a vacuum formed in the cavity when the purge valve is in an open position.

7. The airlock apparatus of claim 6 wherein the purge valve is a manually operated ball valve.

8. The airlock apparatus of claim 1 wherein the exhaust path includes an exhaust orifice through which the potentially contaminated air is removed from the cavity.

9. The airlock apparatus of claim 1, further comprising an exhaust valve associated with the exhaust path, wherein the exhaust valve is coupled to a vacuum tube and releases the potentially contaminated air from the cavity into the vacuum tube when in an open position.

10. The airlock apparatus of claim 1, further comprising a sealing membrane attached to one of an interior periphery of the outer door and a periphery of an explosion chamber access port.

11. The airlock apparatus of claim 1, further comprising a handle on an exterior portion of the outer door.

12. An airlock apparatus usable with an explosion containment chamber comprising:

a pair of doors including an inner door and an outer door attached to the explosion containment chamber proximate the opening, the pair of doors when in a closed position forming therebetween a cavity; and an airlock cavity ventilation system for continuously purging potentially contaminated air out of the cavity and away from the explosion containment chamber during operation, the ventilation system comprising an exhaust path, a purge path, and an air pressure adjustment device coupled to one of the exhaust path or the purge path to induce the flow of ambient air through the cavity.

13. The airlock apparatus of claim 12 wherein the purge path includes an inlet orifice through which ambient air is introduced into the cavity.

14. The airlock apparatus of claim 12 wherein the exhaust path includes an exhaust orifice through which the potentially contaminated air is removed from the cavity.

15. The airlock apparatus of claim 12, further comprising an air treatment system operatively associated with the exhaust path.

16. The airlock apparatus of claim 12 wherein the air pressure device comprises an exhaust fan coupled to the exhaust path.

* * * * *